United States Patent [19]

Hocq

[11] 4,243,337

[45] Jan. 6, 1981

[54] FOUNTAIN PEN WITH INK REFILL CARRIER

[75] Inventor: Robert Hocq, Boulogne, France

[73] Assignee: Societe Anonyme dite: INTERLIGHT, Villars-sur-Glane, Switzerland

[21] Appl. No.: 954,321

[22] Filed: Oct. 24, 1978

[30] Foreign Application Priority Data

Oct. 26, 1977 [FR] France ..... 77 32194

[51] Int. Cl.[3] ..... B43K 5/00; B43K 5/14; B43K 11/00

[52] U.S. Cl. ..... 401/132; 222/325; 401/134

[58] Field of Search ..... 401/222, 221, 132–135, 401/241, 230; 222/325–327, 105, 88, 83.5

[56] References Cited

U.S. PATENT DOCUMENTS

| | | | |
|---|---|---|---|
| 793,259 | 6/1905 | Wilson | 222/105 X |
| 2,045,774 | 6/1936 | Hirschy | 401/133 |
| 2,061,059 | 11/1936 | Carlson | 401/134 |
| 2,629,362 | 2/1953 | Muench | 401/134 |
| 2,877,935 | 3/1959 | Sherbondy | 222/326 |
| 2,919,677 | 1/1960 | Mansheim | 401/135 |
| 3,237,809 | 3/1966 | Daragan et al. | 222/325 X |
| 3,481,510 | 12/1969 | Allen, Jr. | 222/327 X |

FOREIGN PATENT DOCUMENTS

| | | | |
|---|---|---|---|
| 1187954 | 2/1965 | Fed. Rep. of Germany | 401/133 |

*Primary Examiner*—Steven A. Bratlie
*Attorney, Agent, or Firm*—Brisebois & Kruger

[57] ABSTRACT

The invention relates to a fountain pen of the kind requiring an ink refill, and comprising a body with a writing head at one end thereof and defining an opening at its other end, a loading clip adapted to accommodate the ink refill and to be introduced into the body via its open end, and means for closing said open end.

Such a kind of fountain pen has the advantage that, because there is no separation line along the body to remove and replace the ink refill, the body of the pen can be made of a non-circular shape if required.

The invention is characterised in that the loading clip comprises a base plate defining an aperture in which a front, sealed end of the ink refill can be inserted, two strips each connected at one end to the base plate and extending substantially parallel for accommodating and holding the refill between them, and a connecting element which connects the other ends of the said strips.

The invention also includes within its scope an ink refill adapted particularly for the loading clip having grooves therein which locate on respective ones of the parallel strips of said clip.

10 Claims, 4 Drawing Figures

II
II

FOUNTAIN PEN WITH INK REFILL CARRIER

The present invention relates to fountain pens of the kind requiring an ink refill or cartridge, and to ink refills therefor.

Known cartridge pens of this kind comprise a writing head, a body and a cartridge, the front end of the cartridge being pushed against the writing head to be pierced by suitable means to allow for the passage of the ink. As a general rule, these known cartridge pens have a body which is detachable from the writing head and, to locate the cartridge, the user separates the writing head from the body, plugs the cartridge onto the writing head and then attaches the body to this assembled unit, generally by screwing.

An arrangement of this kind has certain disadvantages. For instance, it requires a mechanical separation between the body itself and the adjacent section which carries the writing head. Above all, however, an arrangement of this kind is particularly impractical when the fountain pen is not circular in section but has a different section such as an oval section, for example. Reconnection by screwing in this case is then virtually impossible, and other reconnecting means which may be envisaged involve considerable mechanical complexity.

An object of the invention is to remedy these disadvantages and to provide an arrangement for the cartridge which does not dictate the cross-sectional shape of the body. Thus, the body may have a non-circular shape, such as a flattened, oval or polygonal shape, for example.

A further object of the invention is to provide an arrangement wherein loading of the refill, as well as its removal does not require the body to be detached from the writing head.

According to one aspect of this invention a fountain pen of the kind requiring an ink refill and comprising a body with a writing head at one end thereof and defining an opening at its other end, a loading clip adapted to accommodate the ink refill and to be introduced into the body via its open end, and means for closing said open end, characterised in that the loading clip comprises a base plate defining an aperture in which a front, sealed end of the ink refill can be inserted, two strips each connected at one end to the base plate and extending substantially parallel for accommodating and holding the refill between them, and a connecting element which connects the other ends of the said strips.

According to a feature of the invention, the length of the loading clip is greater than the length of the ink refills intended for use therewith so that, during withdrawal of the loading clip with an ink refill accommodated therein, it may be drawn out for an initial distance without entraining the refill, so that it emerges sufficiently through the open end of the body to allow a firm hold to be taken, after which continuation of the withdrawal of the loading clip entrains the refill and overcomes the plug-in resistance of the refill on the writing head.

Means for closing the open end of the body of the fountain pen and to hold the loading clip in place may be of any kind. However, in a preferred embodiment, the connecting element of the loading clip may comprise a pivoted flap which can be pivoted between an open, raised position and a folded-down position, closing the open end of the fountain pen, said flap in its raised position being usable as a hold for withdrawing the refill, preferably for the first part of the withdrawal movement during which the refill is not moved.

The flap may be held in the folded-down position in any known way. However, preferably spring means are used, such as, for example, two spring arms which are arranged on either side of the flap when the latter is in the folded-down position. In a particularly favourable form of the invention, when the flap is moved into its folded-down, closed position, it causes the separation of the spring arms, preferably the arms provided for holding the flap in place, to urge these arms against the internal surface of the fountain pen body, either directly on this surface or in notches formed therein, which then effects positive locking in the body of the refill unit with the flap.

However, in another version said spring means are not urged against said internal surface and act simply to hold the flap in the folded-down position, the securing of the loading clip in the body of the fountain pen being effected by a simple friction effect, possibly aided by sufficient outward deformation of the loading clip strips, which then press against the internal wall of the fountain pen body.

According to another aspect of this invention an ink refill for a fountain pen according to said one aspect is characterised in that in two opposite longitudinal sides it has grooves which co-act with corresponding ones at said substantially parallel strips of the loading clip, to hold the refill between them.

Other advantages and characteristics of the invention will become apparent from the following description, given by way of a non-limiting example, with reference to the accompanying drawing, in which.

Figures 1, 2, 3, 4:
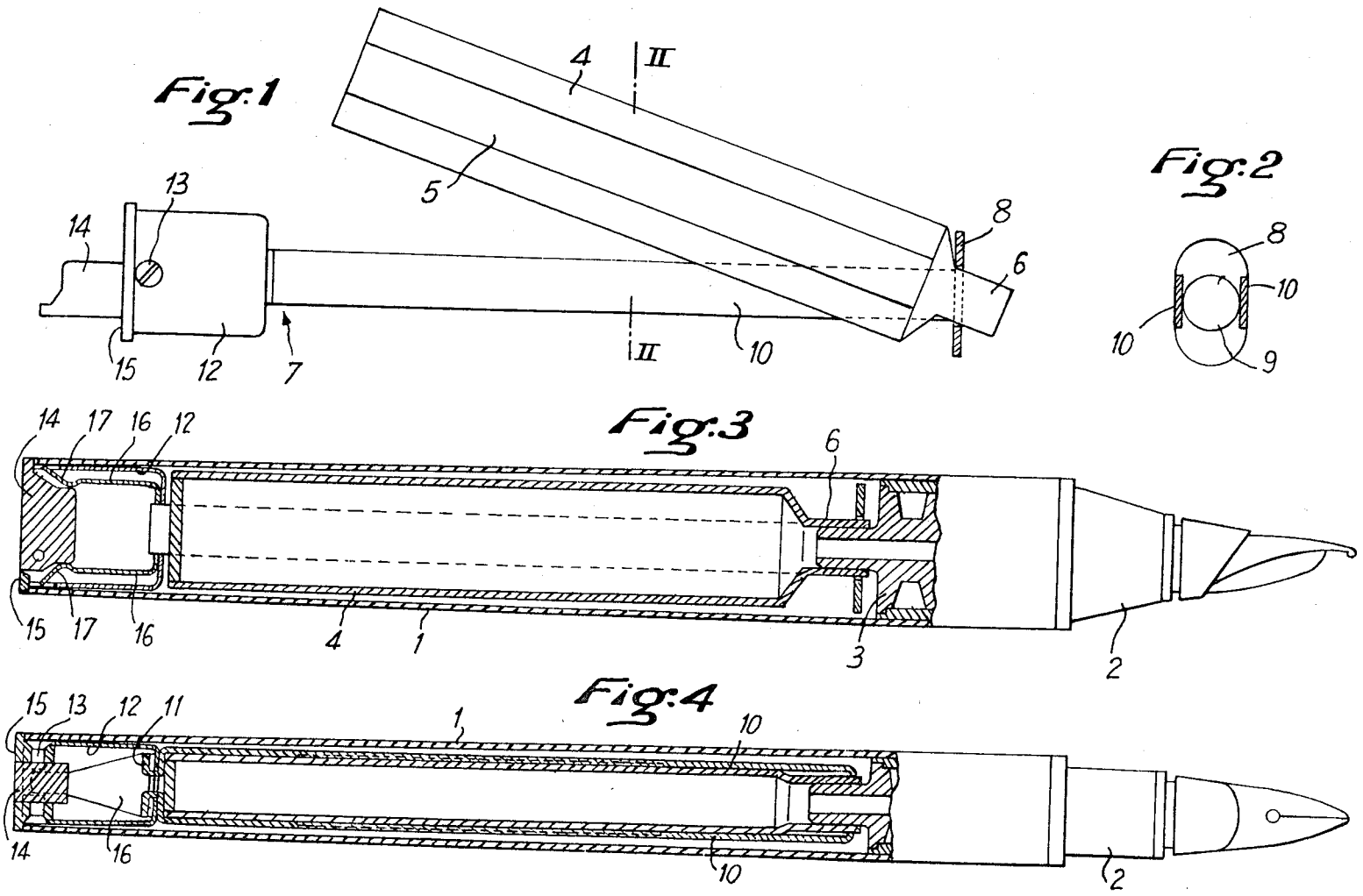
FIG. 1 is a side view of a loading clip in which a refill according to the invention is being inserted.
FIG. 2 is a section along II—II of the loading clip shown in FIG. 1.
FIG. 3 is a section through the loaded fountain pen, looking through a flattened side.
FIG. 4 is a view of the same fountain pen in a section perpendicular to the view of FIG. 3.

The fountain pen shown comprises a body 1 in the form of a cylindrical tube with an oval/flattened cross-section, i.e. a cross-section formed from two rectilinear sections connected by two arcs of a circle at the two ends. A writing head 2 with a nib is located in one end of the body 1, the writing head being enclosed by the body 1 and having a nipple 3 which is able to penetrate a seal in the front end of an ink refill 4 in a known manner.

The refill 4 has a flattened cylindrical form similar to that of the body 1 of the fountain pen, although of smaller dimensions. There is a wide flat-bottomed, shallow groove 5 on each of the planar faces of the cartridge designed to accommodate loading clip strips described in more detail below.

The front part of the refill 4 has a sealed neck portion 6 designed to plug onto the nipple 3 so that the seal can be broken to allow the ink of the refill to communicate with the nib.

A loading clip 7 is provided which is adapted to accommodate the ink refill 4, the clip comprising an oval base plate 8 of approximately the same dimensions as the ink refill 4 having a circular aperture 9; from this base plate two parallel, resilient loading clip strips 10 extend. The other ends of these strips 10 are bent to form hooks 11 which are clipped into an orifice of a connecting element in the form of an oval casing 12, again of approximately the same dimensions as the ink refill 4.

The casing 12 has a transverse pivot 13 around which a flap 14 can pivot from an open position (shown in FIG. 1) to a closed position (shown in FIG. 3) flush with the rear face 15 of the casing 12.

As can be seen in FIGS. 3 and 4, the hooks 11 of the strips 10 hold a U-shaped spring 16; the ends 17 of the two arms of this spring are bent out appropriately and fulfill, a dual function. On one hand, they engage the innermost part of the flap 14, as shown in FIG. 3, to resist accidental opening of this flap since the user would have to overcome a certain amount of force to open the flap 14.

On the other hand, said innermost part of the flap 14, in locating between the two arms of the spring, pushes the ends 17 laterally through openings in the casing 12 so positioned to allow the ends 17 of the arms to pass therethrough and engage against the internal surface of the body 1 to provide a gripping effect which resists withdrawal of the loading clip assembly. Alternatively, the ends 17 of the arms may engage in notches (not shown) formed in said internal surface. As shown in FIG. 1, once a used refill has been removed from the loading clip 7, a new refill 4 is put in place by introducing its neck 6 through the orifice 9 of the base plate 8, then pushing the body of the refill until the strips 10 locate in their respective shallow grooves 5. As shown, the length of the refill 4 is such that it fits within the length of the strips 10.

The loaded clip is then introduced into the body 1 of the fountain pen by sliding it in via the rear open end of the body. Thus, the neck end 6 engages the nipple 3 of the writing head 2 and continuation of the sliding movement initially causes the refill to slide relatively to the loading clip until the rear end of the refill engages the hooks 11 of the strips 10, after which the neck 6 is forced onto the nipple 3. The body 1 is then closed by folding down the cap 14, which then effects the separation of the ends 17 of the spring 16 to positively secure the loaded clip in said body.

To remove a used refill 4, it is first necessary to pivot the flap 14 to its open position, after freeing it from the arms of the spring 16, after which traction can be exerted on the flap to draw out the loaded clip by an axial sliding movement. During this sliding movement the refill, which is plugged onto the nipple 3, initially remains stationary until plate 8 engages the transitional zone between the neck 6 and the body of the refill, after which increased traction makes it possible for the refill entrained by the loading clip 7 to be disengaged from the nipple 3. By arranging for the first part of the travel path to be of an appropriate length, it is possible to draw out from the body 1 a sufficient amount of the casing 12 to take a firm hold, which in turn makes it possible to exert the increased traction required to disengage the neck 6 from the nipple 3. After the loaded clip has been withdrawn completely from the body, the refill can be removed and replaced by a new one as described above.

Although the invention has been described with reference to a particular embodiment, it is of course in no way limited thereby, and various modifications may be made in its form or in its materials within the scope of the following claims.

I claim:

1. An ink refill fountain pen comprising, a body with a writing head at one end thereof and defining an opening at its other end, a removable loading clip adapted to accommodate the ink refill and to be introduced into the body via its open end, and wherein said loading clip comprises, a base plate defining an aperture in which a front, sealed end of the ink refill can be inserted, two strips each connected at one end to the base plate and extending substantially parallel for accommodating and holding the refill between them, and connecting means which connects the other ends of the said strips, said connecting means of the loading clip including a pivotable flap which can be pivoted between an open, raised position and a folded-down position closing the open end of the fountain pen, said flap in its raised position providing manually grippable means for withdrawing the refill.

2. A fountain pen according to claim 1, wherein the length of the loading clip is greater than the length of the ink refills intended for use therewith so that during withdrawal of the loading clip with an ink refill accommodated therein the clip may be drawn out for an initial distance without moving the refill, thereby permitting the clip to emerge sufficiently from the open end of the body to allow firmly gripping the clip.

3. A fountain pen according to claim 1, wherein said connecting means further comprises two spring arms on either side of the flap to hold said flap in its closed position.

4. A fountain pen according to claim 3, wherein said spring arms have ends adjacent said flap, and movement of the flap into its closed position forces apart the ends of said spring arms to urge them against an internal surface of the fountain pen body to effect positive locking of said loading clip in the body.

5. A fountain pen according to claim 4, wherein the connecting means comprises a casing having openings positioned to allow the ends of the spring arms to pass therethrough to engage the internal surface of the fountain pen body as the flap is closed.

6. A fountain pen according to claim 1, wherein said connecting means comprises a casing in which the flap is pivoted.

7. A fountain pen according to claim 1, wherein said other ends of the strips are bent to provide hooks which extend into an orifice defined in said connecting means.

8. A fountain pen according to claim 1, wherein said body has an oval/flattened cross-section.

9. An ink refill for a fountain pen with a loading clip according to claim 1, wherein two opposite longitudinal sides of said refill define grooves which co-act with corresponding ones of said substantially parallel strips of said loading clip, to hold said refill between said strips.

10. An ink refill according to claim 8 or 9 wherein said refill has an oval/flattened cross-section of smaller dimensions than said body of the pen.

* * * * *